US006409329B1

(12) United States Patent
King

(10) Patent No.: US 6,409,329 B1
(45) Date of Patent: Jun. 25, 2002

(54) METHOD AND DEVICE TO PREVENT FOREIGN METALLIC OBJECT DAMAGE IN FLUID EJECTION SYSTEMS USING MICROWAVE DRYERS

(75) Inventor: William L. King, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 17 days.

(21) Appl. No.: 09/771,553

(22) Filed: Jan. 30, 2001

(51) Int. Cl.[7] ..... B41J 2/01
(52) U.S. Cl. ..... 347/102
(58) Field of Search ..... 347/102, 101, 347/104, 105, 106, 107, 43, 4, 95, 85; 241/34, 38, 36, 46.016

(56) References Cited

U.S. PATENT DOCUMENTS

| | | | | |
|---|---|---|---|---|
| 5,318,229 A | | 6/1994 | Brown | |
| 6,089,702 A | * | 7/2000 | Hilton | 347/89 |
| 6,155,669 A | * | 12/2000 | Donahue et al. | 347/42 |
| 6,293,649 B1 | * | 9/2001 | Anderson | 347/29 |

* cited by examiner

*Primary Examiner*—Raquel Gordon
(74) *Attorney, Agent, or Firm*—Oliff & Berridge, PLC

(57) ABSTRACT

A metal detection system and method to reduce damage due to the introduction of metal into microwave dryers of fluid ejection systems. One embodiment of the invention causes paper pick-up rollers and feed rollers to stop when metal is detected. Another embodiment causes the electromagnetic field in the microwave dryer to be turned off when metal is in the drying cavity of the microwave dryer.

6 Claims, 4 Drawing Sheets

METHOD AND DEVICE TO PREVENT FOREIGN METALLIC OBJECT DAMAGE IN FLUID EJECTION SYSTEMS USING MICROWAVE DRYERS

BACKGROUND OF THE INVENTION

1. Field of Invention

The invention relates to fluid ejection systems that use microwave dryers.

2. Description of Related Art

A fluid ejection system, such as an ink jet printer, typically has at least one printhead from which droplets of fluid are directed towards a recording medium or recording sheet. Within the printhead, the fluid is contained in a plurality of channels. Droplets of the fluid are expelled as required from orifices or nozzles located at the end of the channels.

A fluid ejector head may be incorporated into either a carriage type fluid ejection system, a page-width type fluid ejection system, or a combination of the two. The carriage type fluid ejection system typically has a relatively small fluid ejector head containing the fluid channels and nozzles. The fluid ejector head is often sealingly attached to a disposable fluid supply cartridge. The combined fluid ejector head and cartridge assembly is attached to a carriage, which is reciprocated to eject fluid according to one swath of information at a time on a receiving medium. After the swath is formed, the receiving medium is stepped a distance equal to the height of the swath, or a portion of the swath, so that the next swath overlaps or is contiguous with the previous swath. The procedure is repeated until all of the information has been used. In contrast, the page-width fluid ejection system includes a fluid ejector head having a length sufficiently long to eject fluid across the width or length of the receiving medium. The receiving medium is continually moved past the page-width fluid ejector head in a direction normal to the length of the fluid ejector head and at a constant or varying speed during the fluid ejection process.

Many fluids, particularly those used in ink jet printing, include a colorant and a liquid. Some fluids also include a low vapor pressure solvent. When fluid is ejected onto the receiving medium, the individual spots of fluid deposited on the receiving medium form a desired pattern. Once deposited, the liquid is removed from the fluid to leave a desired residue.

Liquid can be removed from the fluid and the receiving medium by a number of methods. One simple method is natural air drying, in which the liquid component of the fluid deposited on the receiving medium is allowed to evaporate without mechanical assistance. A significant amount of fluid is diffused and absorbed into the receiving medium when this method is used. In high-speed page-width fluid ejection systems, drying is usually achieved by transporting the receiving media through a microwave dryer to evaporate the liquid from the fluid.

Microwave dryers are particularly efficient for drying fluid on receiving media in high speed thermal ink jet printing. However, introducing foreign metallic materials, such as, for example, staples, paper clips, decorative metallic leaf on letterhead and the like, into a microwave dryer cavity can have damaging consequences when the dryer is generating electromagnetic waves. Any metal entering the microwave dryer cavity under these conditions will immediately couple microwave power. This causes the metal to heat up dramatically and to arc and possibly damage the microwave dryer. Receiving media and transport belts in close proximity to the metal and the arc will rapidly heat up and deform. Damage to transport belts can affect the output quality of the fluid receiving medium, affect the reliability of the entire fluid ejection system and frustrate the user. Further, electromagnetic coupling results in electromagnetic radiation from the cavity of the microwave dryer which is a safety hazard. Preventing this problematic scenario requires assuring that foreign metallic materials cannot enter the microwave dryer cavity when microwave RF power is applied.

SUMMARY OF THE INVENTION

This invention provides systems and methods that detect metallic materials during feeding recording media to the ejection area of the fluid ejection system.

This invention separately provides systems and methods that reduce damage to a microwave dryer by stopping feeding operations upon detecting offending materials and allowing the removal of the offending materials.

This invention separately provides systems and methods that detect metallic materials prior to entry of such metallic materials into a microwave dryer.

This invention additionally provides systems and methods that reduce damage by turning off microwave power when metallic materials are detected in this manner.

This invention separately provides systems and methods that detect metallic materials after the offending materials exit from a microwave dryer and to turn on microwave power after the metallic materials exit the microwave dryer cavity.

These and other features and advantages of this invention are described in, or are apparent from, the following detailed description of various exemplary embodiments of the systems and methods according to this invention.

BRIEF DESCRIPTION OF THE DRAWINGS

Various embodiments of this invention will be described in detail, with reference to the following figures, wherein.

DETAILED DESCRIPTION OF PREFERRED EMBODIMENTS

The following detailed description of various exemplary embodiments of the fluid ejection systems according to this invention are directed to one specific type of fluid ejection system, an ink jet printer, for sake of clarity and familiarity. However, it should be appreciated that the principles of this invention, as outlined and/or discussed below, can be equally applied to any known or later developed fluid ejection systems, beyond the ink jet printer specifically discussed herein.

Figure 1:
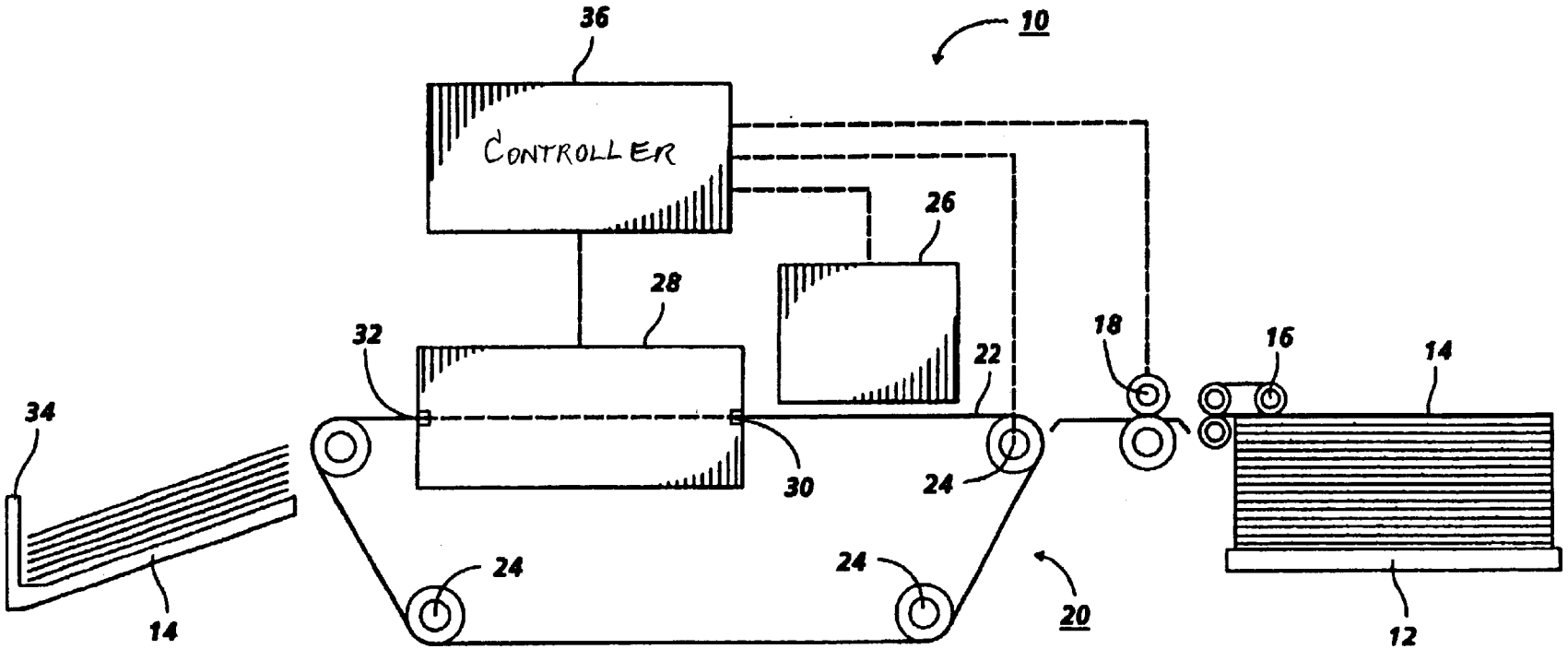
FIG. 1 is a schematic view of an exemplary embodiment of a conventional ink jet printer suitable for use with the this invention.

FIG. 1 illustrates a schematic view of an exemplary embodiment of a conventional ink jet printer 10. The ink jet printer 10 includes an input tray 12 containing cut sheets 14 of paper stock to be printed upon by the ink jet printer 10. Single sheets 14 of paper are removed from the input tray 12 by one or more pick-up rollers 16 and fed by one or more feed rollers 18 to a paper transport mechanism 20. The paper transport mechanism 20 moves the sheet 14 by one or more feed belts 22 driven by rollers 24 beneath a printing member 26. The belts 22 are made of a material transparent to microwave power having a low dielectric constant. The printing member 26 includes a page-width ink jet printhead which deposits ink on the sheet 14 as the sheet moves past the printhead. The page-width ink jet printhead is a linear array of print nozzles as wide as the sheet so that ink is deposited across the entire width of a sheet. This invention is equally applicable, however, to printers having an ink jet printhead which moves across the sheet 14 periodically, in swaths, to form the image, much like a typewriter. The print member 26 includes an ink supply and the necessary electronics to control the deposition of ink on the page.

In various exemplary embodiments, the ink that is used is formulated to be heatable using microwave power. Such ink may include compounds designed to couple with the microwave power for increasing the amount of heat introduced into the ink by the microwaves. One such compound is an ionic compound at least partially ionizable in the liquid vehicle. U.S. Pat. No. 5,220,346 discloses a suitable ink and is incorporated herein by reference in its entirety.

Once the sheet 14 has been printed, the sheet 14 is carried by the paper transport mechanism 20, immediately after printing or within about 5 seconds or less, to a microwave dryer 28. The sheet 14 enters an input slot 30 and exits an output slot 32. A transport mechanism, such as one using a vacuum applied to the bottom side of the paper or one using a static mat, carries the paper through the microwave dryer 28. As the sheet 14 passes through the microwave dryer 28, microwave power is delivered to the sheet 14 to dry the ink deposited on the sheet 14. Once the sheet 14 is substantially dry, the sheet is sent to an output tray 34.

A controller 36 controls the printing member 26, the microwave dryer 28, and the paper transport mechanism 20 as outlined above. In addition, an adaptive dryer control can also be used. U.S. Pat. No. 5,214,442 discloses such an adaptive dryer control and is incorporated herein by reference in its entirety.

The microwave dryer 28 has such a fast drying rate that the excess liquid in the ink on the substrate is evaporated from the surface of the printed sheet before any appreciable absorption occurs. Additionally, microwave power generated in the microwave dryer 28 produces an electromagnetic field sufficiently powerful to effectively dry a thin layer of ink on the sheet 14.

Figure 2:
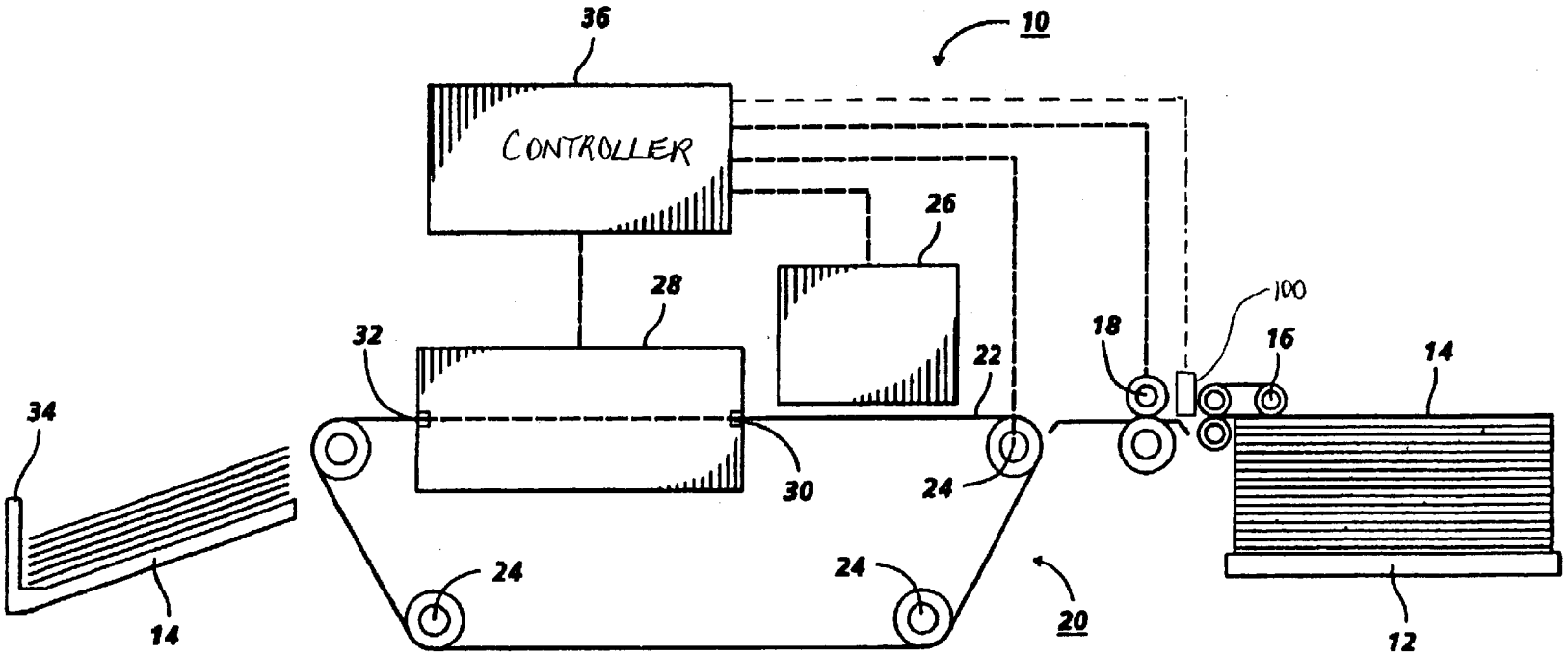
FIG. 2 is a schematic view of an exemplary embodiment of the printing portion of an ink jet printer incorporating a first exemplary embodiment of the detection and control system according to the invention.

FIG. 2 illustrates schematic view of an exemplary embodiment of an ink jet printer incorporating a first exemplary embodiment of a metal detection and damage avoidance system according to this invention. In this first exemplary embodiment, a metal detector 100 is placed between the one or more pick-up rollers 16 and the one or more feed rollers 18. The metal detector 100 may be designed to detect one or more articles made of iron, such as staples, paper clips or metallic letterheads. This metal detector 100 detects the magnetic properties of the iron-containing articles, and is very well known. Various exemplary embodiments of a metal detector 100 embody a coil that produces a magnetic field. Any modification of that field by the entry of an iron-containing article is detected and used to control the output of the metal detector.

Another metal detector 100 uses alternating current to produce a magnetic field. When a metal object enters the field, eddy currents are induced in the object. These eddy currents create a counter magnetic field, which alters the net magnetic field sensed by a magnetic field sensor.

These principles of metal detection are disclosed in U.S. Pat. Nos. 4,354,178 and 2,179,240. Both ferrous and non-ferrous metals may be detected, as demonstrated in the 178 patent.

When metal is detected, the metal detector 100 sends a signal to the controller 36. In response, the controller 36 stops the one or more pick-up rollers 16 and the one or more feed rollers 18 and displays a message to the user indicating that the jam is due to metal detected on the stopped sheet. The sheet can then be removed to a purged output. Once the sheet is removed, the metal detector no longer detects the metal. Thus, the signal to the controller 36 is removed. As a result, the controller allows printing to resume.

Figure 3:
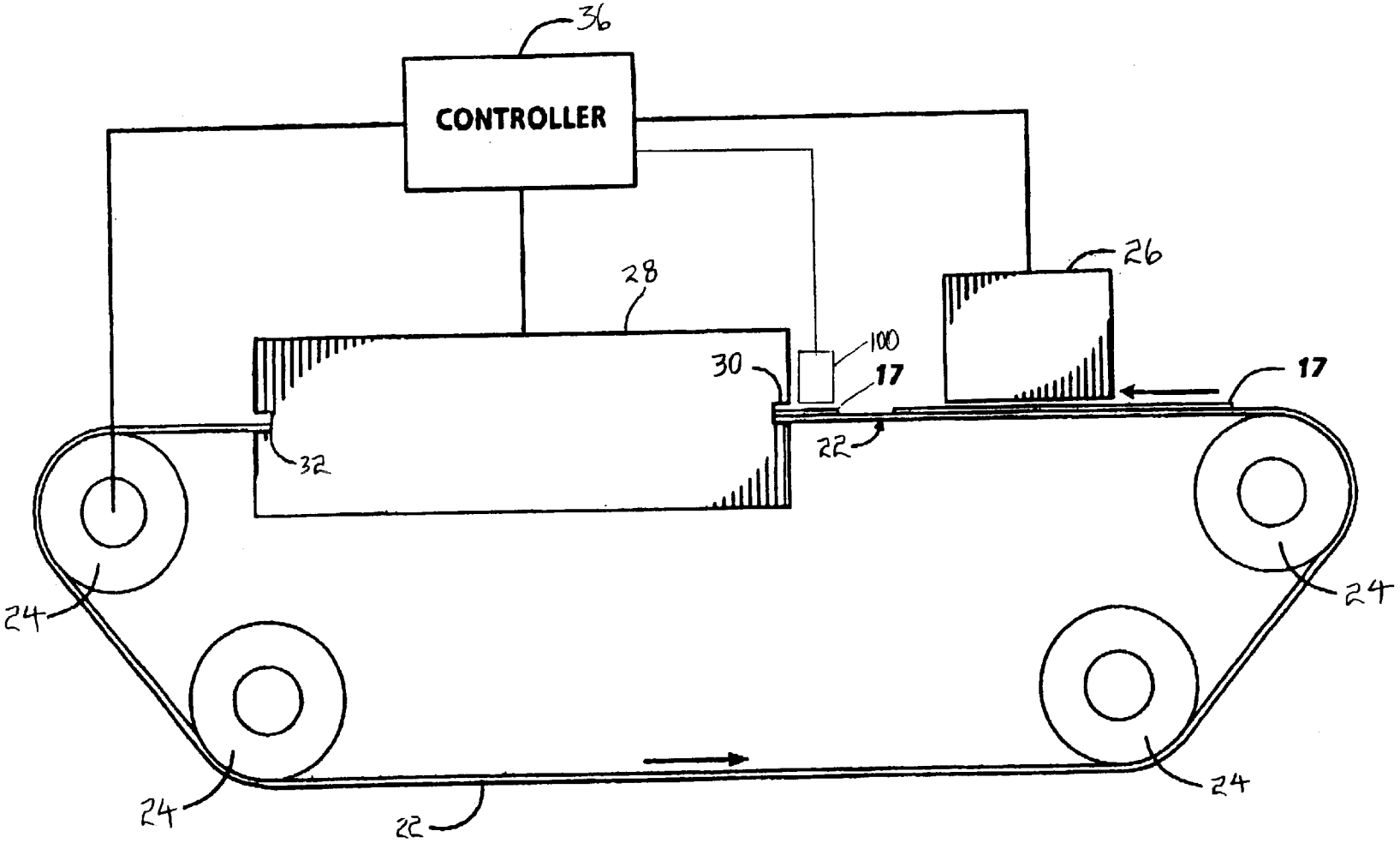
FIG. 3 is a schematic view of an exemplary embodiment of the printing portion of an ink jet printer incorporating a second exemplary embodiment of the detection and control system according to the invention.

FIG. 3 is a schematic view of an exemplary embodiment of an ink jet printer incorporating a second exemplary embodiment of the metal detection and damage avoidance system according to this invention. In this embodiment, a metal detector 100 is placed outside the microwave dryer 28 immediately prior to the input portion or slot 30. When the metal detector 100 detects metal, the metal detector sends a signal to the controller 36. In response, the controller 36 shuts off power to the microwave dryer 28. In this embodiment, the controller 36 uses the speed of the belt 22 to determine when the metal detected by the metal detector 100 has exited the microwave dryer 28. The controller 36 restores power to the microwave dryer 28 when the last metal detected by the metal detector 100 has had time to exit the microwave dryer 28.

Figure 4:
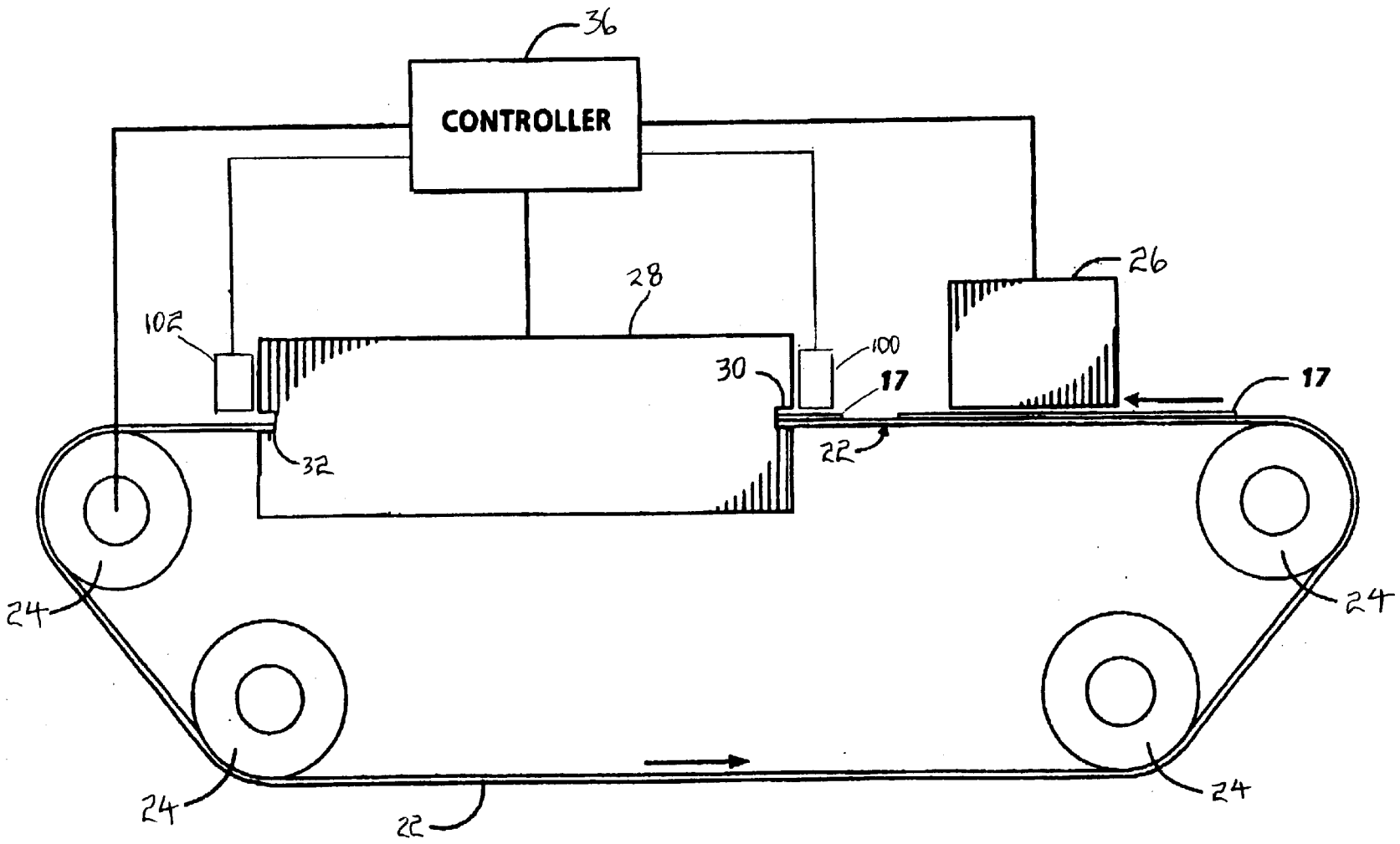
FIG. 4 is a schematic view of an exemplary embodiment of the printing portion of an ink jet printer incorporating a third exemplary embodiment of the detection and control system according to the invention.

FIG. 4 is a schematic view of an exemplary embodiment of an ink jet printer incorporating a third embodiment of the metal detection and damage avoidance system according to this invention. In this third embodiment of the metal detection and damage avoidance system, a first metal detector 100 is placed outside the microwave dryer 28 immediately prior to the input portion or slot 30. A second metal detector 102 is placed outside the microwave dryer 28 immediately after the output portion or slot 32. When the first metal detector 100 senses metal, the first metal detector 100 sends a signal to the controller 36 for as long as the first metal detector 100 senses metal. In response, the controller 36 shuts off power to the microwave dryer 28. When the second metal detector 102 detects metal, the second metal detector 102 sends a second signal to the controller 36. In response, the controller 36 restores power to the microwave dryer 28. The controller 36 restores power when the last element of the metal detected and set by the first metal detector 100 is detected by the second metal detector 102, based on the first and second signals output by the first and second metal detectors 100 and 102.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A fluid ejection system, comprising:

a metal detector placed within a metal detection range of a transport system and between a pick-up roller and an inlet slot of a microwave dryer; and a controller that stops the pick-up roller in response to a signal from the metal detector indicating metal has been detected.

2. A fluid ejection system, comprising:

a metal detector placed near an input slot of a microwave dryer and within a metal detection range of a transport system for a recording medium; and a controller that shuts off power to the microwave dryer in response to receiving an output from the metal detector indicating metal has been detected and that restores power when a last metal object detected by the metal detector has exited the microwave dryer, the time of exit determined based on a speed of the transport system.

3. A fluid ejection system, comprising:

a first metal detector placed near an input slot of a microwave dryer and within a first metal detection range of a transport system;

a second metal detector placed near an output slot of the microwave dryer and within a second metal detection range of the transport system; and a controller that shuts off power to the microwave dryer in response to a signal from the first metal detector indicating metal has been detected and that restores power to the microwave dryer in response to a signal from the second metal detector indicating that a last metal object detected by the first metal detector has been detected by the second metal detector.

4. A method for reducing damage to a microwave dryer of a fluid ejection system due to the presence of metal in a microwave drying cavity, comprising:

transporting a fluid receiving medium within a metal detection range of a metal detector placed between a pick-up roller and an inlet slot of the microwave dryer; and stopping transporting the fluid receiving medium in response to a signal from the metal detector indicating metal has been detected.

5. A method for reducing damage to a microwave dryer of a fluid ejection system due to the presence of metal in a microwave drying cavity, comprising:

transporting a fluid receiving medium within a metal detection range of a first metal detector placed near an input slot of the microwave dryer and a second metal detector placed near an output slot of the microwave dryer; and stopping the microwave dryer from generating an electromagnetic field in response to a signal from the first metal detector indicating that metal has been detected; and operating the microwave dryer to resume generating the electromagnetic field in response to a signal from the second metal detector indicating that a last metal object detected by the first metal detector has been detected by the second metal detector.

6. A method for reducing damage to a microwave dryer of a fluid ejection system due to the presence of metal in a microwave drying cavity, comprising:

transporting a fluid receiving medium within a metal detection range of a metal detector placed near an input slot to the microwave dryer;

stopping the microwave dryer from generating an electromagnetic field in response to a signal from the metal detector indicating metal has been detected; and operating the microwave dryer to resume generating the electromagnetic field after a determined time interval, the time interval determined based on a transport speed of the fluid receiving medium through the microwave dryer.

* * * * *